United States Patent [19]

Ayers

[11] 4,388,350

[45] Jun. 14, 1983

[54] PROCESS FOR DECORATING ARTICLES

[76] Inventor: Anne L. Ayers, P.O. Box 233, Daniels, W. Va. 25832

[21] Appl. No.: 326,347

[22] Filed: Dec. 1, 1981

Related U.S. Application Data

[63] Continuation of Ser. No. 99,922, Dec. 3, 1979, abandoned.

[51] Int. Cl.[3] ..... B05D 3/12; B05D 5/06

[52] U.S. Cl. ..... 427/262; 427/264; 427/267; 427/270; 427/348

[58] Field of Search ..... 427/260, 262, 263, 264, 427/267, 268, 348, 270

[56] References Cited

U.S. PATENT DOCUMENTS

| | | | |
|---|---|---|---|
| 779,655 | 1/1905 | Kenkel | 427/262 |
| 1,217,660 | 2/1917 | Stuhlmiller | 427/267 X |

OTHER PUBLICATIONS

Gaynes, Norman I., *Formulation of Organic Coatings*, 1967, D. Van Nostrand Co., Inc., Princeton, N.J., pp. 7, 8, 11 & 12.

*Primary Examiner*—Evan K. Lawrence
*Attorney, Agent, or Firm*—Wilmer Mechlin

[57] ABSTRACT

A process for decorating articles, such as jewelry, is disclosed in which the article is coated with two or more visibly different layers having binders soluble in a common solvent, each layer is dried before the next layer is applied and the final layer is applied wet with the solvent in sufficient concentration to at least soften the binder of any underlying layer. A pattern is made by applying pressure selectively to or otherwise redistributing the final and any at least softened underlying layer to expose one or more of the underlying layers. For example, a concentric wood ring effect is obtained by applying a greater pressure to the central portion of an article such as a ring coated with multiple layers of lacquer.

12 Claims, 4 Drawing Figures

PROCESS FOR DECORATING ARTICLES

This application is a continuation of my copending application Ser. No. 99,922, filed Dec. 3, 1979, abandoned.

SUMMARY OF THE INVENTION

This invention relates to a process for decorating articles, particularly articles of adornment, such as jewelry, by applying multiple coatings and forming a pattern. A wide range of effects can be obtained by selection of visibly different coatings and varying the pattern.

Essentially, the process involves the application of at least two coating layers of solvent soluble coatings containing a binder to the article in which the solvent is a common solvent for the binder and redistributing the layers while the final layer is wet with solvent to expose one or more of the underlying layers. Redistribution can be accomplished by a variety of methods such as the selective application of pressure to certain portions of the final layer or by partial removal of one or more layers. After the pattern is formed the article is allowed to dry and can be protected with an additional layer of transparent or translucent coating.

FIGURE DESCRIPTION

DETAILED DESCRIPTION

Figure 1:
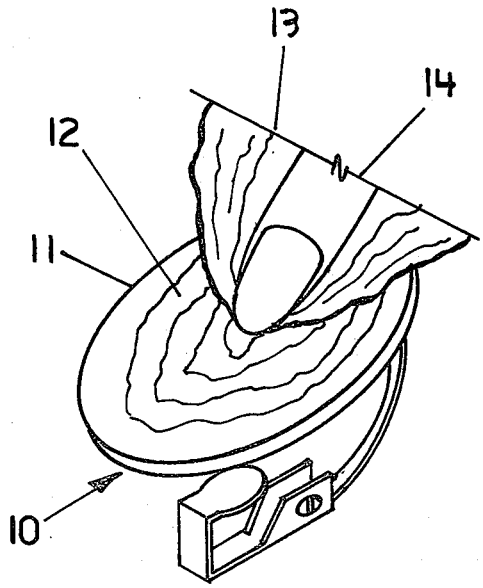
FIG. 1 is a perspective view of an earring being decorated in a concentric wood ring effect by the process of this invention using manual pressure.

The method of decorating articles according to the invention relates primarily, but not exclusively, to articles of adornment, such as jewelry. As used herein, the term "articles" is intended to embrace portions of the body, specifically fingernails and toenails as well as articles which are not commonly considered as jewelry, for example, belt buckles, small boxes, paper weights and the like.

A wide variety of coating compositions are suitable for use in this invention the only essential requirement being that the several coatings required, i.e. two or more visually different coatings, contain binders having a common solvent and that the common solvent be used for applying the final decorative layer. The final decorative layer is the last layer applied before the step of redistribution of the coatings to form a pattern is conducted. While an additional layer can be applied, for example for protection of the decorated article, such an additional layer is not considered a final decorative layer unless it is redistributed to form a pattern in accordance with this invention and it is dissolved in a solvent which is common for the layer or layers beneath. Thus, a protective layer can be, but is not necessarily, soluble in the same solvents as the decorative layers which are essential to this invention and the application of a final protective layer is not essential to the method of this invention. However, it is often desirable and advantageous to utilize a clear or colored transparent protective layer for the articles decorated in accordance with this invention.

The coating compositions used in this invention comprise three essential ingredients, namely a solvent, a binder and a coloring agent which can be a transparent soluble dye or a pigment. The solvent required in the process of this invention is a common solvent for the binder in the various layers, it being recognized in the art that pigments are insoluble coloring agents.

The essential constituents of the coating compositions useful in the method of this invention can vary widely as long as the requirement for a common solvent for the binder in the several layers is satisfied and the coatings are visually different. Typically, the solvent is an organic solvent such as ketone or an ester, but water can serve as the solvent as well as mixtures of water and organic solvent.

The binder can be an organic polymer such as a cellulose ester, for example cellulose acetate, or an acrylate polymer such as poly(methyl acrylate) or it can be a naturally derived binder, such as shellac. Suitable binders include, but are not limited to, those present in compositions known as lacquers. Typical lacquers eminently suitable for use in the invention are those marketed as fingernail polish.

The coloring agent in the coating compositions used in this invention can be in the form of a pigment which is insoluble in the composition and which results in an opaque or partially opaque coating, or in the form of a dye which is soluble in the composition and gives a colored transparent or translucent coating. Pigments are either organic or inorganic. Dyes are normally organic in nature.

A wide variety of pigments or dyes can be used. For example the coloring agents whether they be pigments, dyes or mixtures thereof can be selected to give coatings which are of any hue and character including black and white, irridescent, metallic, phosphorescent or fluorescent.

By appropriate selection of the coatings in the various layers and distribution of the coatings an almost limitless variety of pattern effects can be obtained including textured, speckled, marbled, frosted, flaked or lined. It is also possible to obtain predetermined patterns such as specific designs, numbers, letters and the like.

In its simplest form the method of this invention involves the application of two coatings which are visually different and which have a common solvent, one on top of the other and redistribution of the coatings while the top layer is solvent wet. It should be recognized that redistribution while the topmost layer is solvent wet can be accomplished by drying the topmost layer and rewetting it with a common solvent for it and the first layer. The same principles and procedures apply whether two or more coatings are utilized.

Redistribution of the coatings is accomplished by any suitable means such as by the application of pressure selectively to the coating or by scraping. Pressure can be applied manually, with an instrument such as a knife, or brush, or with a patterned die or with a fluid such as liquid, gas or air.

The selection of coatings and patterns insofar as the aesthetic effect obtained is not critical to this invention. It should be apparent that complimentary or clashing color combinations can be selected and that practically any kind of variegated or even psychedelic pattern is possible.

It is essential to this invention that the solvent in the final decorative layer be of a type and a concentration which at least softens the layer immediately beneath it. Thus, the method of this invention does not embrace multiple coatings in which the layer beneath the final decorative layer is cured in such a way that it is not soluble in solvent used for the final decorative layer. Illustrative of underlay coatings which are not part of this invention are those which are cured by the cross-linking or oxidation with air so that they are no longer substantially soluble in or softened by the common solvent.

It is also essential to this invention that the final decorative layer be uniformly applied and then redistributed in such a way that at least certain portions, one or more of the underlying layers, become visible to form the desired pattern. Thus, the process of this invention should be distinguished from painting a house, for example, where a topcoat different in color from the primer layer is used, because the object there is to obtain a uniform top layer and not to redistribute the top layer after it is uniformly applied so that the underlayer shows through in a pattern. The process of this invention is also to be distinguished from the method commonly referred to as "antiquing" because in antiquing a final uniform layer is not applied and then selectively removed while wet and because the solvent for the final layer is not typically a solvent for the base layer. Rather, the top layer is normally applied in a streaked or speckled pattern from a solvent which does not disturb the base layer.

Finally the process of this invention is distinguished from artistic techniques used in oil or acrylic painting, for instance, where paint applied with a brush or spatula is redistributed on the surface with a spatula or other implement. In such techniques the final layer is not normally applied uniformly as in this invention but in a desired pattern which is subsequently altered.

The invention is illustrated by the following non-limiting examples.

EXAMPLE 1

As shown in FIG. 1 an earring 10 is coated with five layers by alternating layers of two different colored fingernail polishes 11 and 12. Each layer is dried briefly before the next layer is applied except that while the last layer is still wet pressure is applied to the center of the coated earring with the finger 14 covered with a tissue 13 moistened with fingernail polish remover to redistribute the coatings. A clear concentric ring effect as shown in FIG. 1 is obtained. After drying a protective coating of clear or translucent fingernail polish is applied.

EXAMPLE 2

Figure 2:
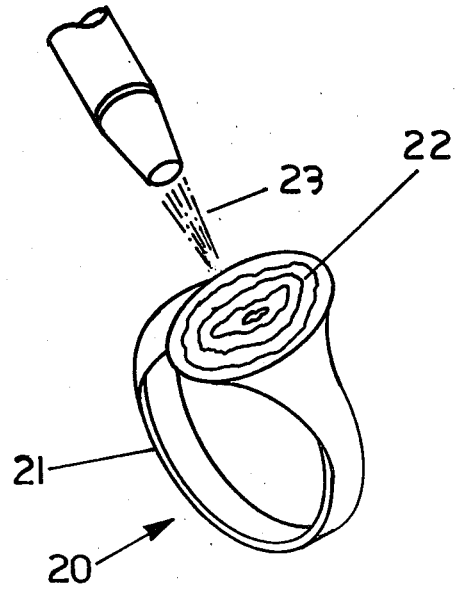
FIG. 2 is a perspective view of a ring being decorated by a different embodiment of the process of this invention in which a jet of air is used to redistribute the layers of coloring matter.

In FIG. 2 a ring 20 coated outside the fingerhole area 21 with several layers 22 of differently colored fingernail polishes is shown. Each layer is briefly dried prior to application of the next layer. A jet of air 23 is directed against the coated area while it is still wet with the final coating. A concentric ring effect is obtained. Optionally, a protective coating of clear or transluscent fingernail polish is applied after the final decorative layers have dried.

EXAMPLE 3

Figure 3:
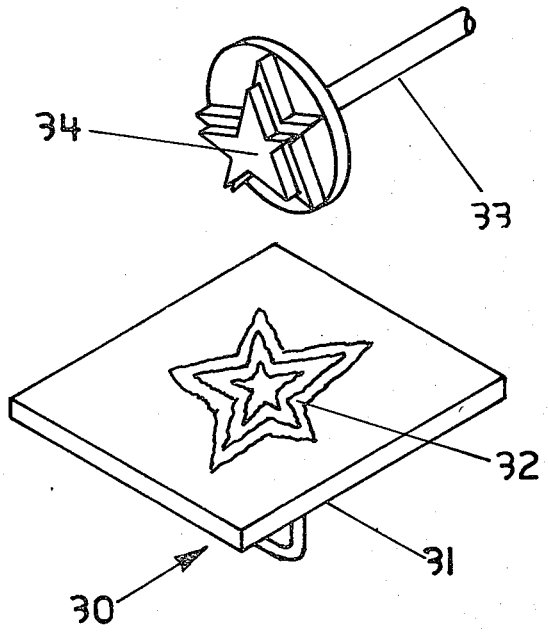
FIG. 3 is a perspective view of another embodiment of this invention in which a star die is used to redistribute the colored layers in a belt buckle by selective application of pressure.

In FIG. 3 a belt buckle 30 coated on its face 31 with several layers 32 of differently colored acrylic lacquers is shown. Each layer is briefly dried prior to the application of the next layer. While the final layer is still wet a die 33 with a star relief design 34 is pressed against the coated belt buckle. A star shaped design is obtained on the face of the belt buckle. After drying of the coatings the belt buckle is optionally overcoated with a clear or translucent protective lacquer layer.

EXAMPLE 4

Figure 4:
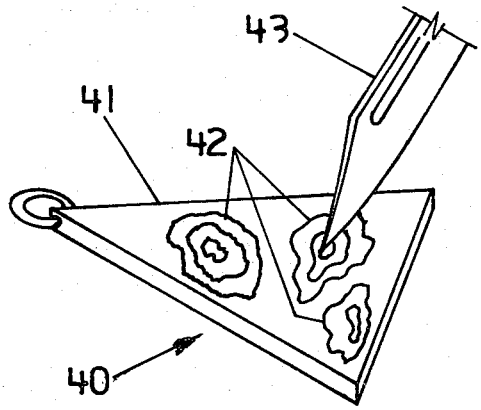
FIG. 4 is a perspective view of scraping with a knife being used for removing and redistributing portions of the coatings on a pendant to obtain a pattern.

In FIG. 4 a pendant 40 is coated on one face 41 with several layers of acrylic lacquer 42. Each coating is dried before the application of the next layer. While the final layer is still wet the coatings are redistributed with a knife 43 in the desired pattern. Some of the coating is removed and the remainder allowed to flow out and dry. After drying the pendant is optionally overcoated with a clear or translucent protective lacquer layer.

I claim:

1. A process for decorating an article comprising the steps of (a) coating said article with a first layer of a colored coating composition containing a solvent solution of a binder;

(b) overcoating said first layer substantially uniformly with one or more subsequent layers of coating composition containing a solvent solution of a binder, each of which is different visually from the preceding layer, in which said solvent for each is a solvent for the binder in the first layer and for the binder in each subsequent layer;

(c) drying each layer before applying a subsequent layer;

(d) while the last of said subsequent layers is wet with said solvent in sufficient concentration to at least soften the binder of any one or more of said underlying layers, redistributing said last and said at least softened underlying layer or layers to form a decorative pattern by exposure of one or more of the underlying layers; and (e) drying the last and the at least softened underlying layer or layers.

2. The process of claim 1 wherein the step of redistributing is accomplished by applying pressure selectively to one or more of the subsequent layers.

3. The process of claim 1 wherein the step of redistributing is accomplished by selectively removing part of one or more of said subsequent layers.

4. The process of claim 1 wherein one or more of said subsequent layers are of sufficient translucency to allow the underlying layer to show through.

5. The process of claim 1 wherein a concentric wood ring effect is obtained by conducting redistribution with greater pressure applied to the central portion of the final layer than the peripheral portions.

6. The process of claim 1 wherein a predetermined decorative pattern is obtained by conducting redistribution with pressure applied by a member having the predetermined pattern in relief.

7. The process of claim 1 wherein redistribution is conducted by applying pressure to selected areas with a gas stream.

8. The process of claim 1 wherein said last layer is first dried and then rewetted with said solvent for said layers before the redistributing step d.

9. The process of claim 1 wherein said article is an article of adornment.

10. The process of claim 1 wherein said article is an article of jewelry.

11. The process of claim 1 wherein said article is metallic.

12. The process of claim 1 wherein said article is enamelled metal.

* * * * *